US006659465B2

(12) United States Patent
Yiu

(10) Patent No.: US 6,659,465 B2
(45) Date of Patent: Dec. 9, 2003

(54) SILENT DART BOARD

(76) Inventor: Chin-Hao Yiu, 7F-1, No. 30, Lin Sen Rd., Taichung (TW)

( * ) Notice: Subject to any disclaimer, the term of this patent is extended or adjusted under 35 U.S.C. 154(b) by 0 days.

(21) Appl. No.: 10/120,997

(22) Filed: Apr. 12, 2002

(65) Prior Publication Data

US 2003/0193144 A1 Oct. 16, 2003

(51) Int. Cl.[7] ..... F41J 5/04
(52) U.S. Cl. ..... 273/374; 273/371; 273/403
(58) Field of Search ..... 373/371–376, 373/403, 408

(56) References Cited

U.S. PATENT DOCUMENTS 4,239,573 A * 12/1980 Wu ..... 156/245
5,788,244 A * 8/1998 Hui et al. ..... 273/374
6,047,968 A * 4/2000 Lu et al. ..... 273/371
6,116,607 A * 9/2000 Cho ..... 273/371
6,394,458 B2 * 5/2002 Chang ..... 273/376
6,499,740 B2 * 12/2002 Yiu ..... 273/403

FOREIGN PATENT DOCUMENTS

GB 2247629 * 3/1992

* cited by examiner

*Primary Examiner*—Mark S. Graham
(74) *Attorney, Agent, or Firm*—Charles E. Baxley

(57) ABSTRACT

A dart board includes a backing plate with a frame connected thereto and a plurality of ribs on the frame so as to define a plurality of partitions in which a plurality of blocks are movably received respectively. Each block has flexible convex portions which contact an inside of the ribs defining the partition when the block is hit by darts. A plurality of spring members are connected between the backing plate and the blocks so as to bounce the blocks back after the impact disappears.

4 Claims, 6 Drawing Sheets

SILENT DART BOARD

FIELD OF THE INVENTION

The present invention relates to a dart board that does not generate noise when the blocks are hit by the darts.

BACKGROUND OF THE INVENTION

A conventional dart board is shown in FIG. 6 and generally includes a frame 10 which is connected on a backing plate 13 and a plurality of electronic members 12 are connected on the backing plate 13. The frame 10 includes a plurality of partitions separated by ribs on the frame 10 and each partition receives a block 11 therein. A dart 14 hits one of the blocks 11 and the block 11 being hit moves toward the backing plate 13 and activates the electronic members 12 so as to display scores that the throw gains. It is necessary to maintain a gap between the inside of the partitions and the blocks 11 so that the blocks 11 are allowed to move toward the backing plate 13. Nevertheless, noise is generated when the block 11 is moving and the impact between the blocks 11 and the frame 10 no matter what material is used to make the block 11. Besides, other blocks 11 that do not hit could shake and generate noise. The noise really reduces the feeling of entertainment of the players.

SUMMARY OF THE INVENTION

The present invention relates to a dart board which comprises a backing plate and a frame is connected to the backing plate. A plurality of ribs extend from the frame to define a plurality of partitions in which a plurality of blocks are movably received respectively. Each block has flexible convex portions which contact an inside of the ribs defining the partition. A plurality of spring members are connected between the backing plate and the blocks.

The primary object of the present invention is to provide a dart board that generates no noise when the darts hits the blocks.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
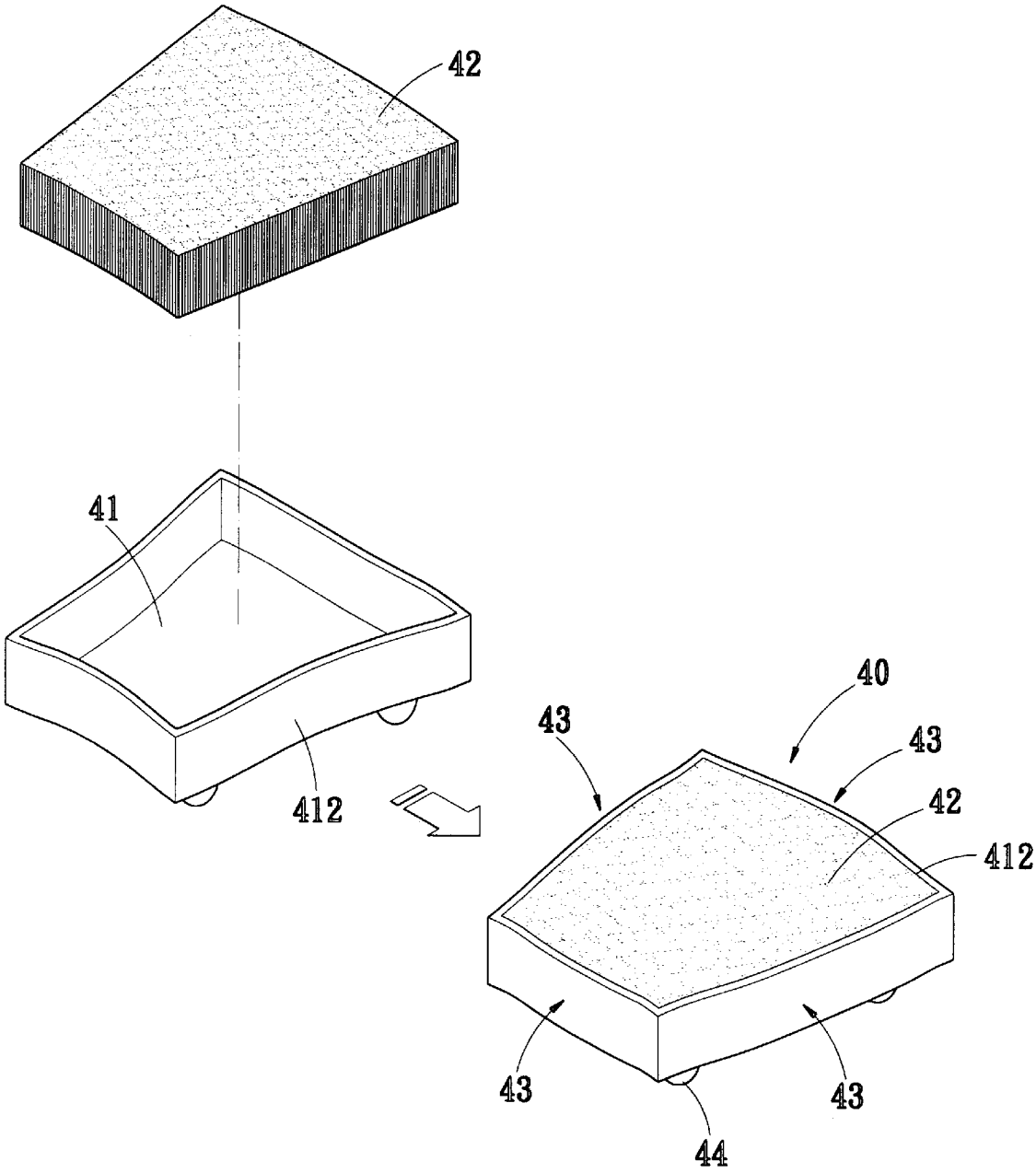
FIG. 1 is an exploded view to show a block member and a casing of the dart board of the present invention.
Figure 2:
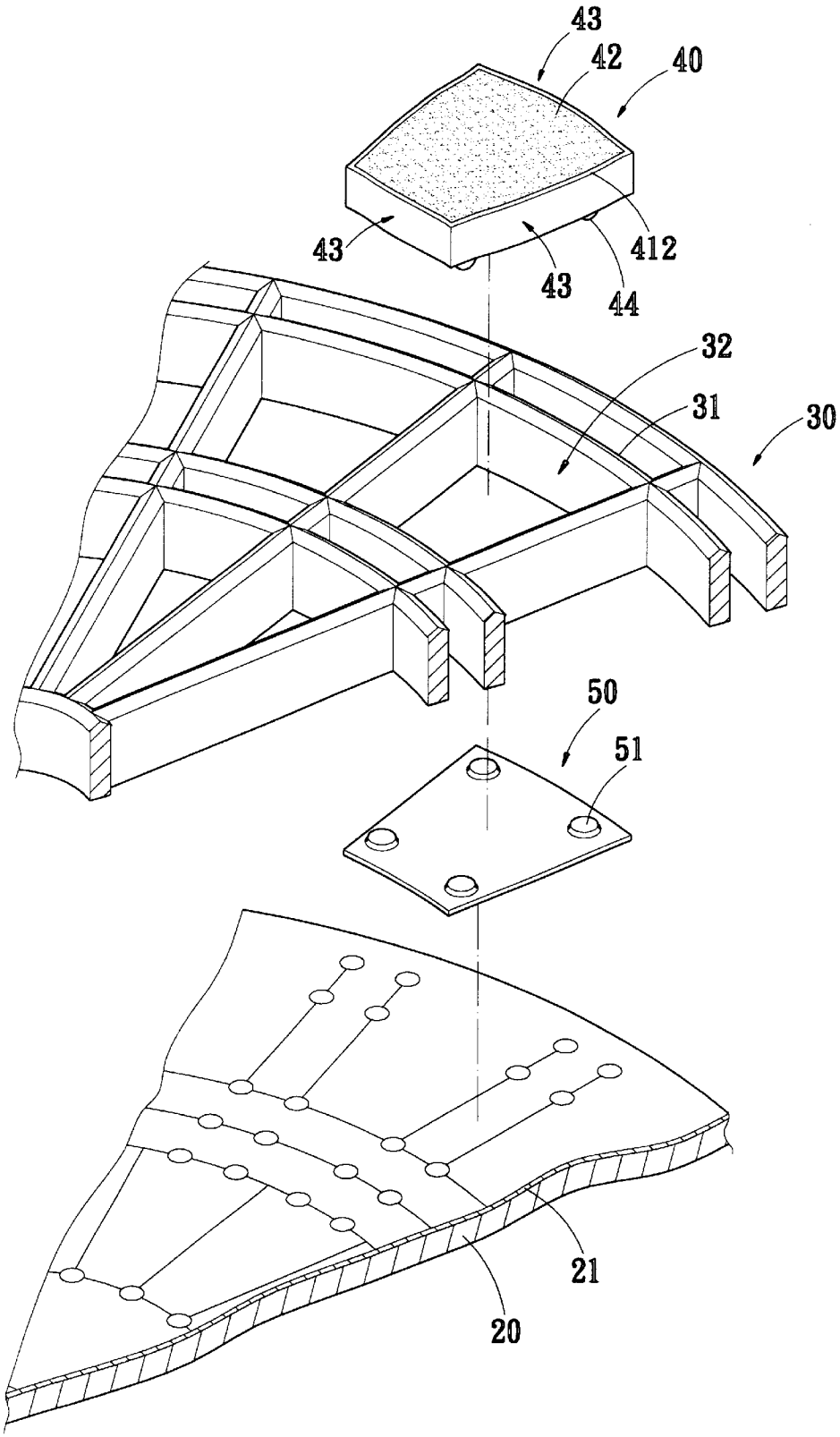
FIG. 2 is an exploded view to show the dart board of the present invention.
Figure 3:
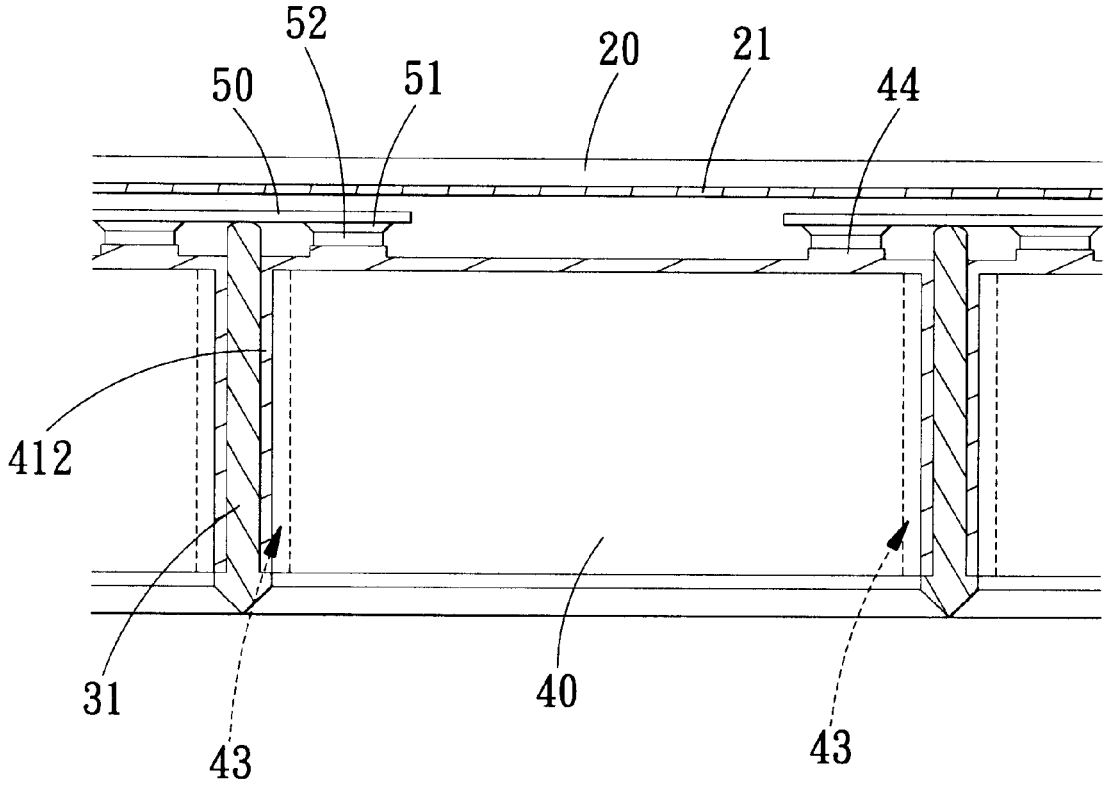
FIG. 3 is a cross sectional view to show the dart board of the present invention.

Referring to FIGS. 1 to 3, the dart board of the present invention comprises a backing plate 20 and a frame 30 is connected to the backing plate 20. A plurality of ribs 31 extend from the frame 30 and define a plurality of partitions 32 in various areas. An electronic plate 21 is connected to the backing plate 20 and located between the frame 30 and the backing plate 20.

A plurality of blocks 40 are movably received in the partitions 32 respectively and each block 40 comprises a casing 41 in which a block member 42 is received from an open top of the casing 41. Each casing 41 has a flexile peripheral wall 412 which is expanded by the block member 42 to be the convex portions 43 which contact an inside of the ribs 31 defining the partition. The block members 42 each are made by artificial fibers which are force-fitted in the casing 41 so as to expand the flexible peripheral wall 412 to be the convex portions 43. Each casing 41 has protrusions 44 extending from an underside thereof.

A plurality of spring members 50 are connected between the backing plate 20 and the blocks 40. The springs 50 each have a plurality of bosses 51 extending therefrom and electronic pads 52 are sandwiched between each of the bosses 51 and the protrusions 44. The electronic pads 52 are electrically connected to the electronic plate 21.

Figure 4:
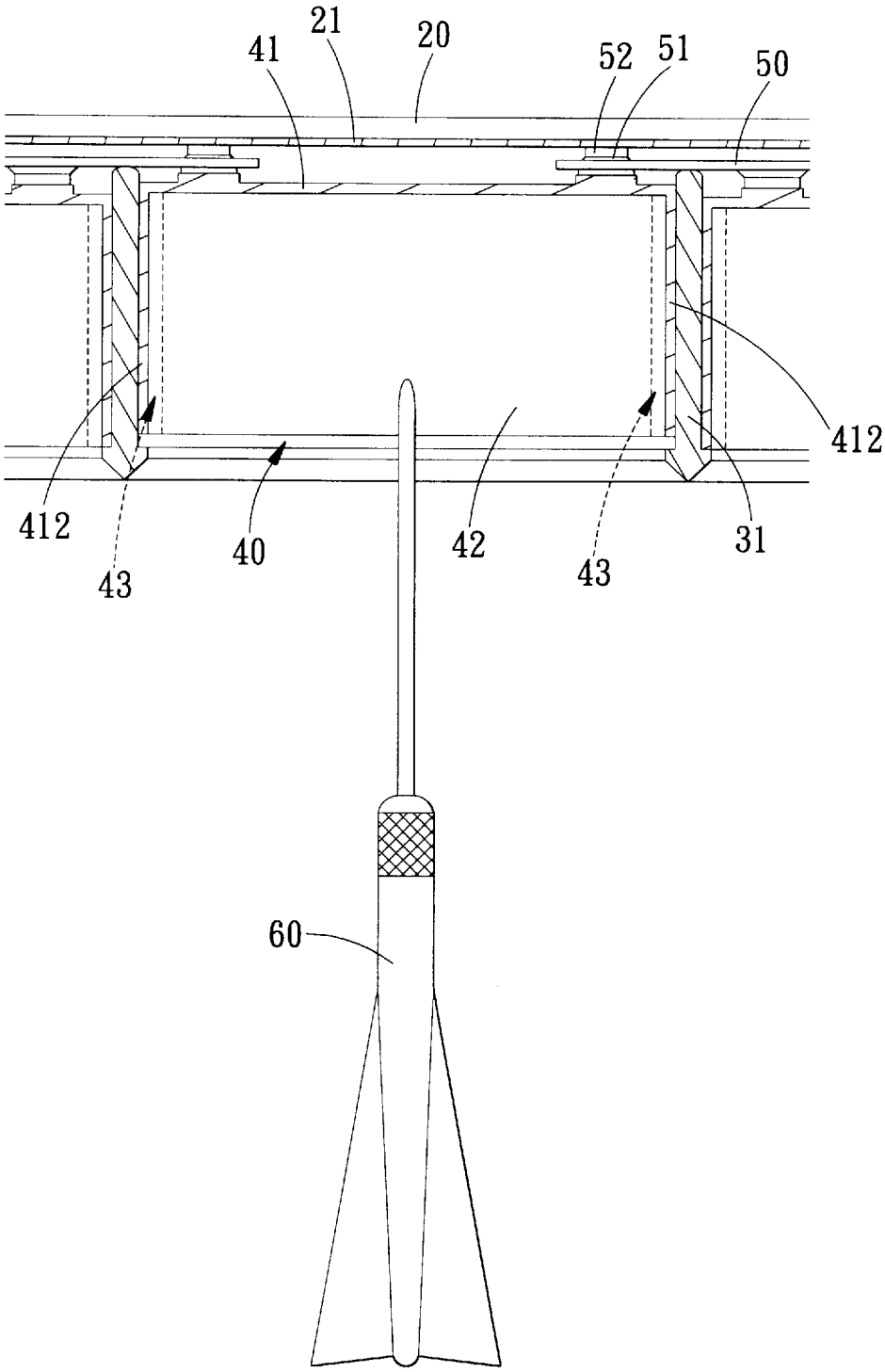
FIG. 4 shows that a dart hits the block member of the dart board of the present invention.
Figure 5:
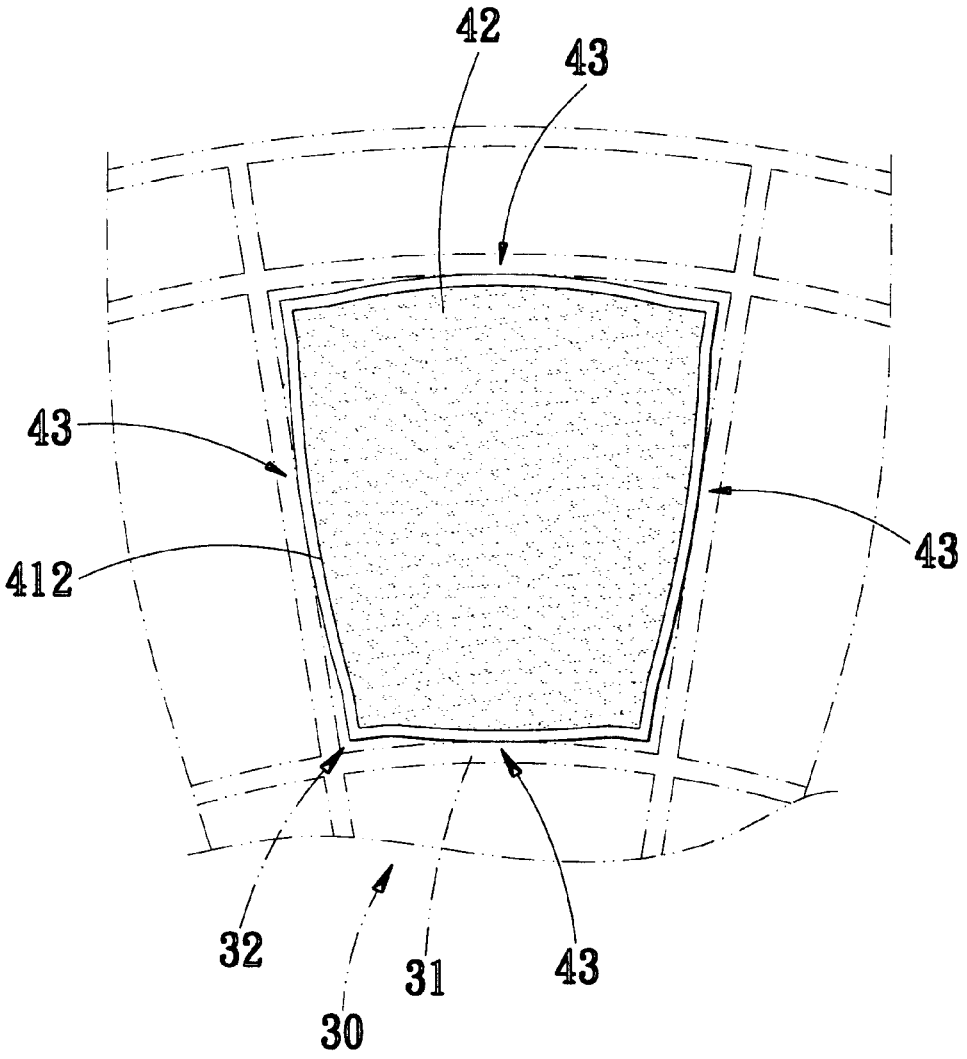
FIG. 5 is a top view to show that the block member received in the casing is engaged in a partition of the dart board of the present invention.
Figure 6:
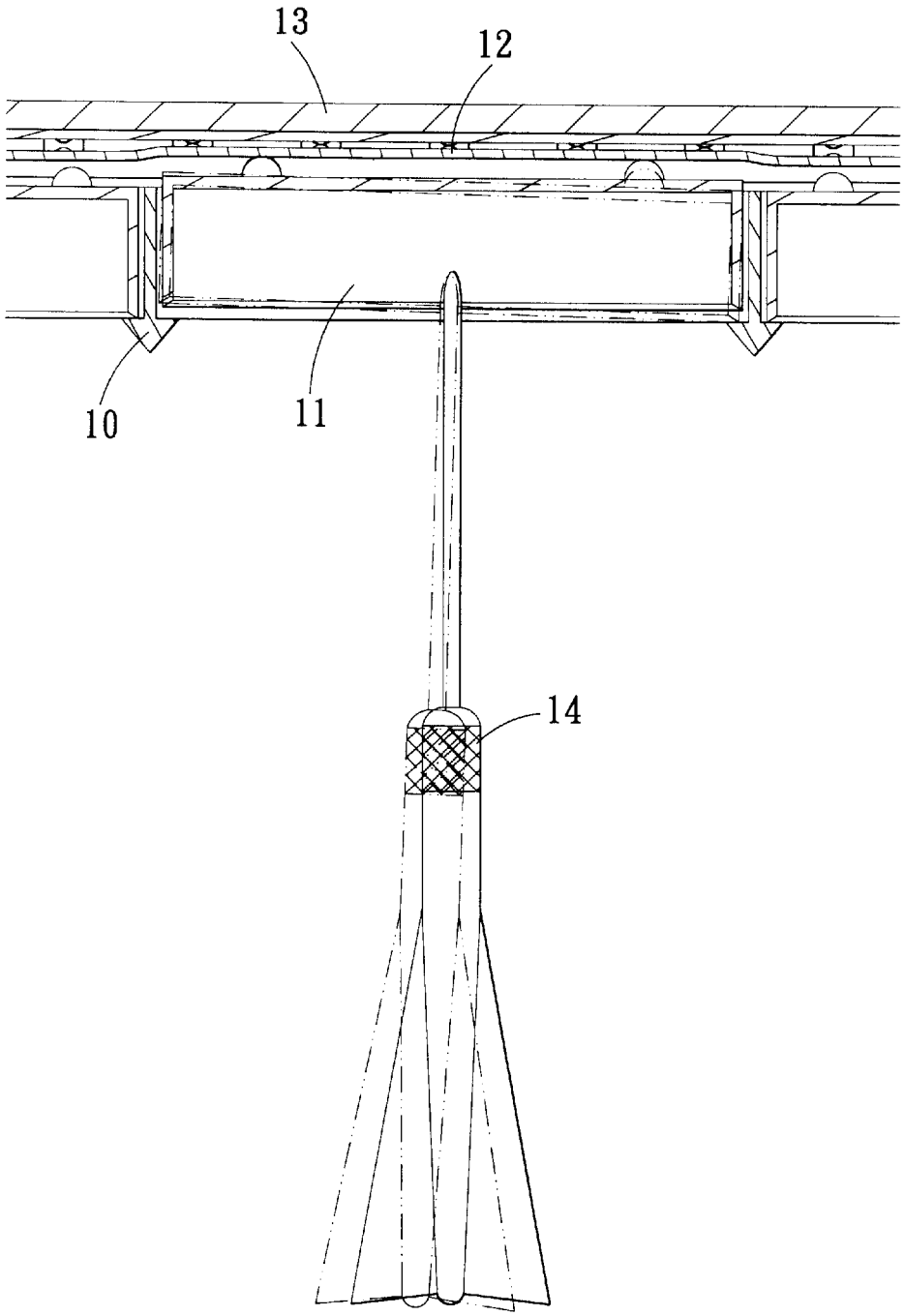
F I G. 6 PRIOR ART
FIG. 6 shows a dart hits a block of a conventional dart board.

Referring to FIGS. 4 and 5, when the block 40 is hit by a dart 80, the block 40 moves toward the backing plate 20 and the convex portions 43 contact the ribs 31 defining the partition 32 that the block 40 is received during the movement. The block 40 does not shank or impacts the ribs 31 so that noise is not generated. After the impact disappears, the spring member 50 pushes the block 40 back to its original position.

It is to be noted that the block member 42 and the casing 40 can be made to be a one-piece member. The convex portions 43 are still flexible and absorb noise during the movement of the blocks 40.

While we have shown and described the embodiment in accordance with the present invention, it should be clear to those skilled in the art that further embodiments may be made without departing from the scope of the present invention.

What is claimed is:

1. A dart board comprising:

a backing plate and a frame connected to the backing plate, a plurality of ribs on the frame and a plurality of partitions defined by the ribs;

a plurality of blocks movably received in the partitions respectively and each block having flexible convex portions which contact an inside of the ribs defining the partition, each block comprising a casing in which a block member is received, each casing having a flexile peripheral wall which is expanded by the block member to be the convex portions, and a plurality of spring members connected between the backing plate and the blocks.

2. The dart board as claimed in claim 1, wherein the springs each have a plurality of bosses extending therefrom which contact the block mounted thereto.

3. The dart board as claimed in claim 1, wherein the springs each have a plurality of bosses extending therefrom and each casing has protrusions extending from an underside thereof, the bosses contacting the protrusions.

4. The dart board as claimed in claim 3 further comprising a plurality of electronic pads sandwiched between each of the bosses and the protrusions.

* * * * *